US006212842B1

(12) United States Patent
Martinez

(10) Patent No.: US 6,212,842 B1
(45) Date of Patent: Apr. 10, 2001

(54) ROOF COVER ELEMENT

(75) Inventor: Bruno Martinez, Osny (FR)

(73) Assignee: Union Miniere France S.A., Bagnolet (FR)

( * ) Notice: Subject to any disclaimer, the term of this patent is extended or adjusted under 35 U.S.C. 154(b) by 0 days.

(21) Appl. No.: 09/443,302

(22) Filed: Nov. 19, 1999

Related U.S. Application Data

(63) Continuation of application No. PCT/EP98/02831, filed on May 8, 1998.

(30) Foreign Application Priority Data

May 22, 1997 (EP) ..... 97201527

(51) Int. Cl.[7] ..... E04D 1/00

(52) U.S. Cl. ..... 52/519; 52/520; 52/524; 52/525; 52/546

(58) Field of Search ..... 52/519, 520, 524, 52/525, 546

(56) References Cited

U.S. PATENT DOCUMENTS

| | | | | |
|---|---|---|---|---|
| 2,005,219 | * | 6/1935 | Burriss | 52/519 |
| 2,118,191 | | 5/1938 | Goldsmith . | |
| 3,555,758 | * | 1/1971 | Schroter | 52/520 |
| 4,139,974 | * | 2/1979 | Fox | 52/519 |
| 4,223,503 | * | 9/1980 | Hague | 52/478 |
| 4,271,652 | * | 6/1981 | Svensson | 52/520 |
| 4,926,608 | * | 5/1990 | Beauregard | 52/522 |

FOREIGN PATENT DOCUMENTS

| | | | |
|---|---|---|---|
| 528371 | * | 5/1954 | (BE) . |
| 528 371 | | 5/1954 | (BE) . |
| 927893 | * | 11/1947 | (FR) . |
| 2 580 702 | | 10/1986 | (FR) . |

* cited by examiner

*Primary Examiner*—Carl D. Friedman
*Assistant Examiner*—Kevin McDermott
(74) *Attorney, Agent, or Firm*—Antonelli, Terry, Stout & Kraus, LLP

(57) ABSTRACT

A preformed roof cover element consisting essentially of a quadrilateral panel (1) with the shape of an isosceles trapezium whereof the two non-parallel sides (2 and 3) have rims (4 and 5) extending substantially over the whole length of the sides. The rims (4 and 5) are raised on the same panel (1) side. The length of one of the trapezium bases (6) is substantially equal to that of the other base (7) increased by twice the thickness of the rim (4 and 5) wall so as to enable the rim (4 and 5) ends (8) to be engaged on the shortest base (7) side with the panel part bordered by the ends with a predetermined element between the ends (9) located at the longest base (6) side of another element extending in a projection of the predetermined element and parallel to the rims (4 and 5).

10 Claims, 7 Drawing Sheets

ROOF COVER ELEMENT

RELATED APPLICATION

This application is a continuation of copending international patent application number PCT/EP98/02831, filed May 8, 1998.

TECHNICAL FIELD

The present invention relates to a preformed roof cover element consisting essentially of a panel of quadrilateral shape. The panel has on two of its opposite sides, a rim extending substantially over the whole length of these sides. These two rims are raised on the same face of the panel and comprise means making it possible to connect the rim of a first panel to the adjacent rim of an attached second panel oriented in the same direction and located in the same plane as the said first panel.

BACKGROUND AND SUMMARY OF INVENTION

The use of known elements of this type generally requires specialized manpower. Indeed, it is generally necessary to use an on-site crimping machine in order to assemble these elements laterally one to the other and/or the engagement of two successive elements in the longitudinal direction has to be carried out by force which, in certain cases, may pose a problem of alignment and correct positioning.

One of the essential objects of the present invention is to propose a roof cover element which can be mass-produced industrially with precision in a factory at a low cost price compared with known preformed roof cover elements. This implementation does not generally require specific equipment and knowhow. This, in the current circumstances, allows fitting by a single, non-specialist person.

Belgium Patent BE-A-528371 discloses roof cover elements obtained from a rectangular metal sheet. These elements are equipped on their raised edges with a clip and with a stop border allowing the engagement of juxtaposed receiving elements, the folding forming a butt joint. It Is thus unnecessary to resort to the crimping of juxtaposed elements, but the problems caused by force-assembly are not solved.

French Patent FR-A-929893 describes metal roof cover sheets with rolled lateral edges engaging in the corresponding edge of a neighbouring sheet. A stapling device is provided, consisting of a transverse strip welded to the upper part of each sheet and intended to receive a fold of the sheet immediately above. These sheets are rectangular. They have no upright lateral edges forming the said upright joints which guarantee leaktightness in the event of heavy rain.

The roof cover element according to the present invention consists essentially of a panel having substantially the shape of an isosceles trapezium of which the two non-parallel sides have the said rims, the length of one of the bases of the trapezium being substantially equal to that of the other base increased by twice the width of the wall of the said rims, so as to enable the ends of the rims on the side of the shorter base to engage with the ends located on the side of the longer base of another element extending in the extension of the said specific element and parallel to the said rims.

Advantageously, the panel has a retention member on its aforesaid face close to its longer base. The retention member makes it possible to immobilize, with respect to each other and in a specific position, two successive elements engaged in the extension of each other in the longitudinal direction of their rims.

According to a particular embodiment of the invention, the aforesaid retention member has the form of a clip oriented towards the shorter base of the element on which it is provided. This base has an edge which is at least partially folded in the form of a clip towards the face opposite that on which the retention member is arranged. This allows the retention member of a specific element to interact with the aforesaid folded edge of another element engaged in the extension of this specific element in a direction parallel to the longitudinal direction of their rims.

Further details and particular features of the invention will emerge from the description, given hereinbelow by way of non-limiting example, of a particular embodiment of the invention, with reference to the appended drawings.

DETAILED DESCRIPTION OF DISCLOSED EMBODIMENT

Figure 1:
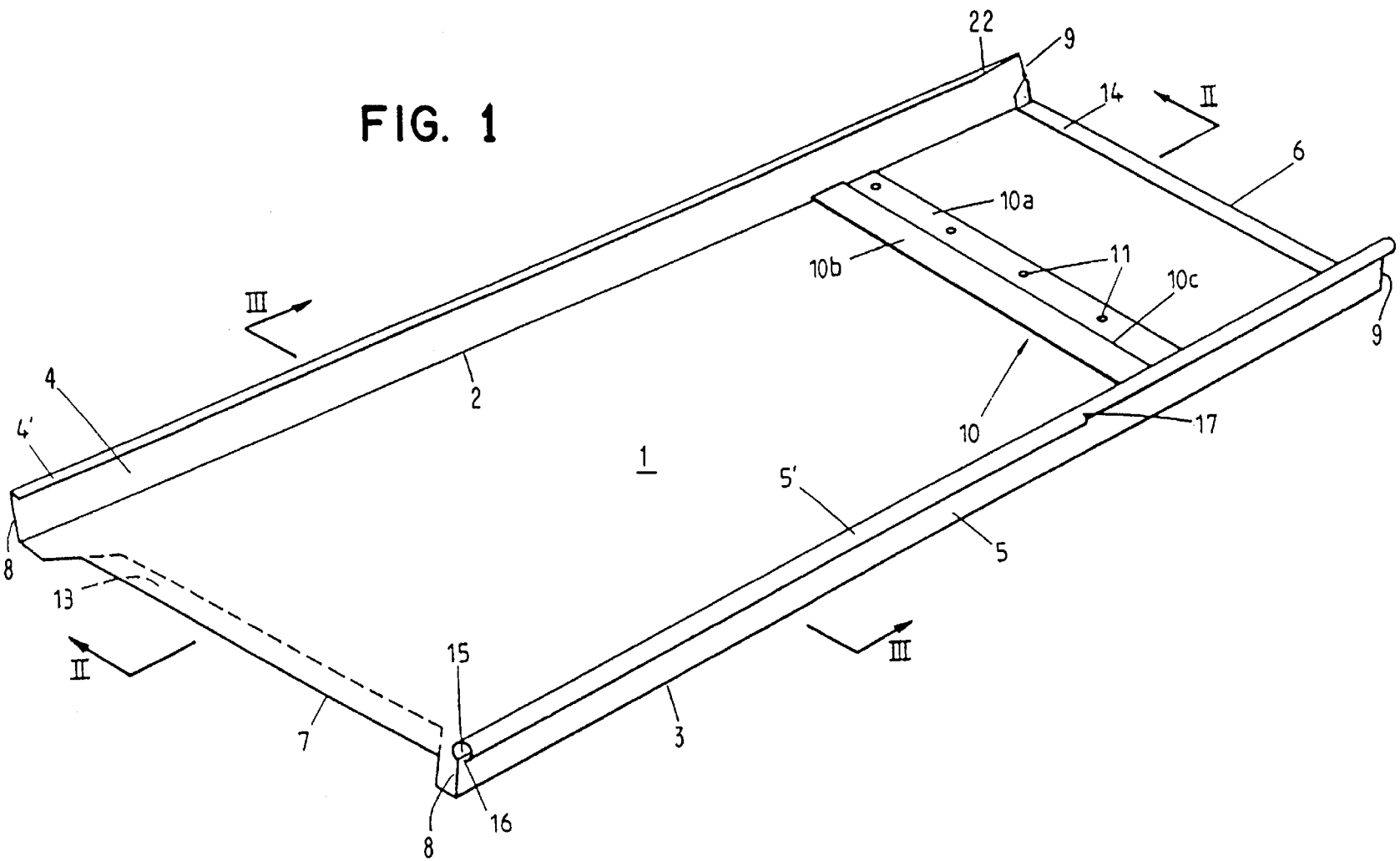
FIG. 1 is a perspective view of a roof cover element according this particular embodiment.

In the various figures, the same reference numerals relate to the same elements.

The particular embodiment of the preformed roof cover element, as shown in the figures, consists essentially of a panel 1. The panel has the shape of an isosceles trapezium. The two non-parallel sides 2 and 3 thereof have two rims 4 and 5 which are raised on the same face of the panel 1. See particularly FIGS. 1, 1*a* and 1*b*.

Figure 1A:
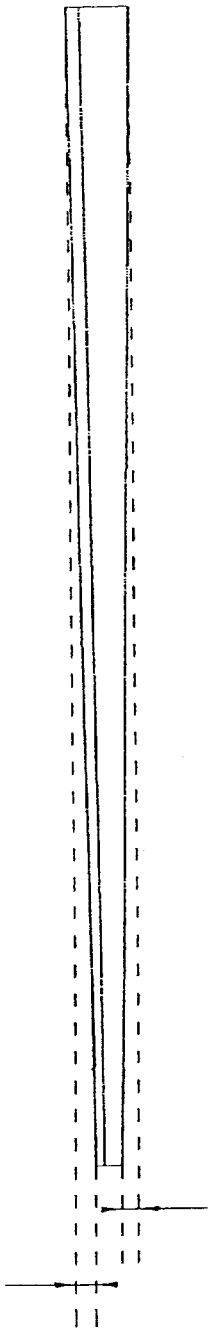
FIG. 1*a* is a side view of the roof cover element, emphasizing the decrease in rim height from one base to the other by at least three times the thickness of the panel.
Figure 1B:
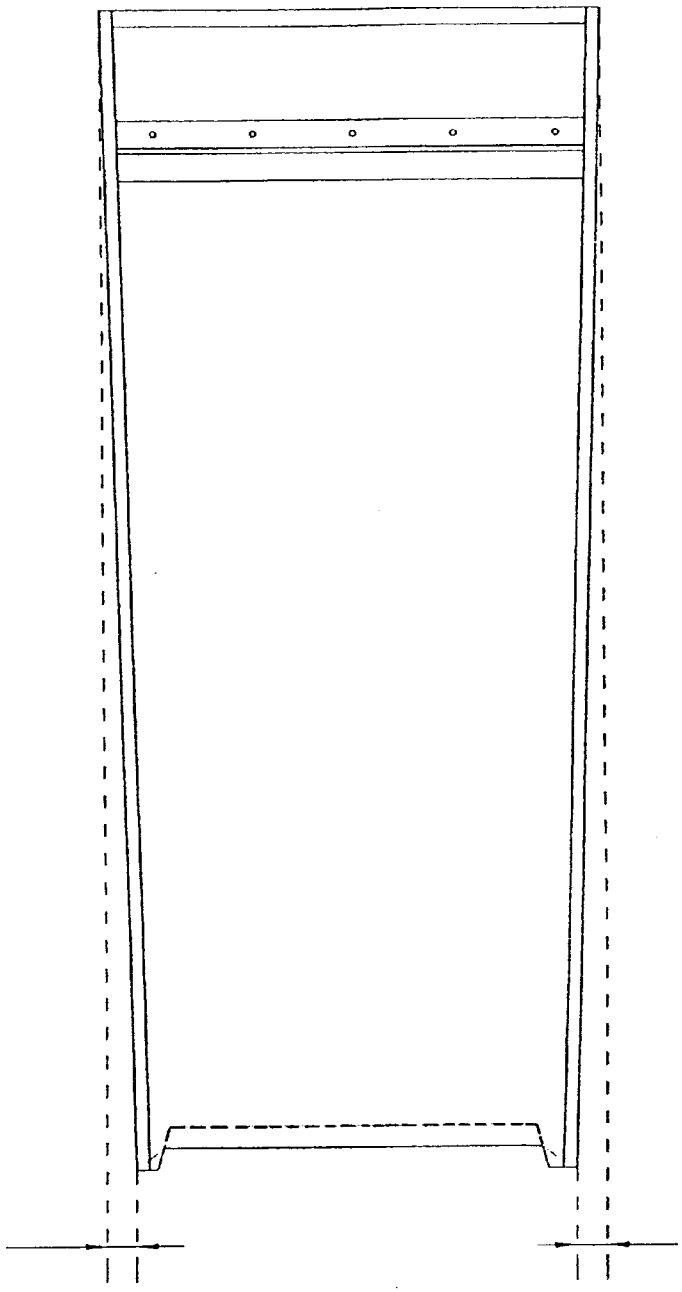
FIG. 1*b* is a top view of the roof cover element, emphasizing the decrease in base length from one base to the other by twice the width of the wall of the rims, enabling the engagement of one element in the other.
Figure 6:
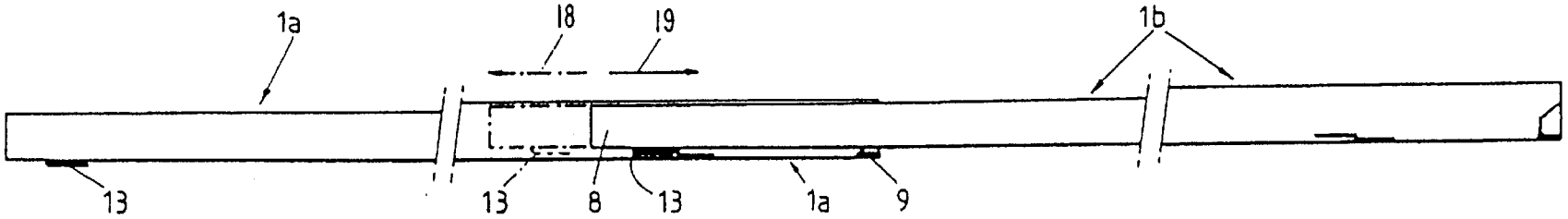
FIG. 6 is a section along the line VI—VI, with interruptions, of FIG. 4.
Figure 7:
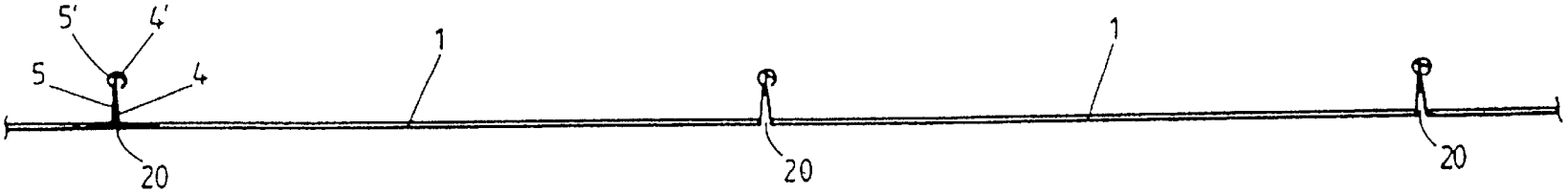
FIG. 7 is a partial section along the line VII—VII of FIG. 4.

The length of the large base 6 of the trapezium is substantially equal to that of the small base 7 increased by twice the width of the wall of the rims 4 and 5 as apparent from FIG. 1*b*. Moreover, the rims 4 and 5 have a geometry such that it is possible to engage their ends 8 on the side of the small base 7 of a specific roof cover element with the opposite ends 9 located on the side of the large base 6 of another element extending in the extension of the first-mentioned element. See FIG. 6.

Figure 2:
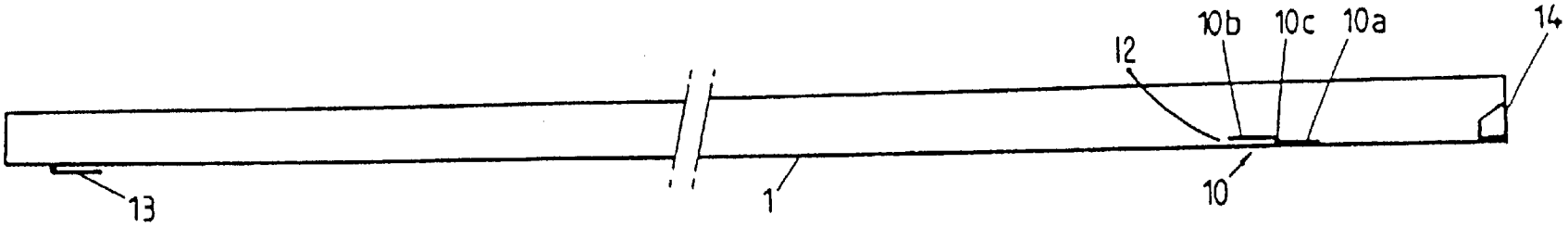
FIG. 2 is a section along the line II—II of FIG. 1.

The panel 1 has, on its upper face, close to its large base 6, a retention member 10, refer to FIGS. 1 and 2. The member 10 makes it possible to immobilize, one panel with respect to the other, in the position in which they are placed on a roof. That is, two successive roof cover elements are engaged in the extension of each other in the longitudinal direction of their rims 4 and 5.

The retention member 10 has the form of a thin strip extending over the width of the upper face of the panel 1 parallel to the large base 6. A transverse section of the member 10 is somewhat in the form of a Z, so as to form two wings 10*a* and 10*b*, FIG. 2, which are connected together via an intermediate zone 10*c* holding these two wings 10*a* and 10*b* at a distance from each other which is somewhat in excess of the thickness of the panel 1.

The wing 10*a*, which is oriented towards the large base 6, is fastened to the panel 1 by means of adapted fastenings 11, such as latching or rivets, so that a slit 12 is made between the panel 1 and the wing 10*b*.

The small base 7 has a folded edge 13, see FIGS. 1 and 2, in the form of a clip on the side of the rear face of the panel 1. The large base 6 had an edge 14, FIG. 1, which is folded towards the upper or front face of the panel 1. The function of the edges 13 and 14 is essentially to allow the fastening of the panels using adapted tabs and to prevent the penetration of water by capillary effect, as will be explained hereinbelow.

Figure 3:
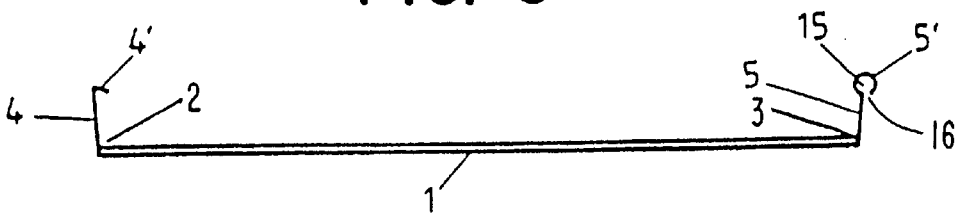
FIG. 3 is a section along the line III—III of FIG. 1.

The free edge 4' of rim 4 is folded towards the other rim 5 as shown in FIG. 3. The free edge 5' of the rim 5 is folded towards the outside of the roof cover element. More particularly, the free edge 4' has a transverse section in the form of a clip, whilst the free edge of the other rim 5 has the shape of a hem or bead 5' delimiting a longitudinal cylindrical hollow 15 and having a slit 16 extending along the outer lateral side of the rim 5.

Figure 4:
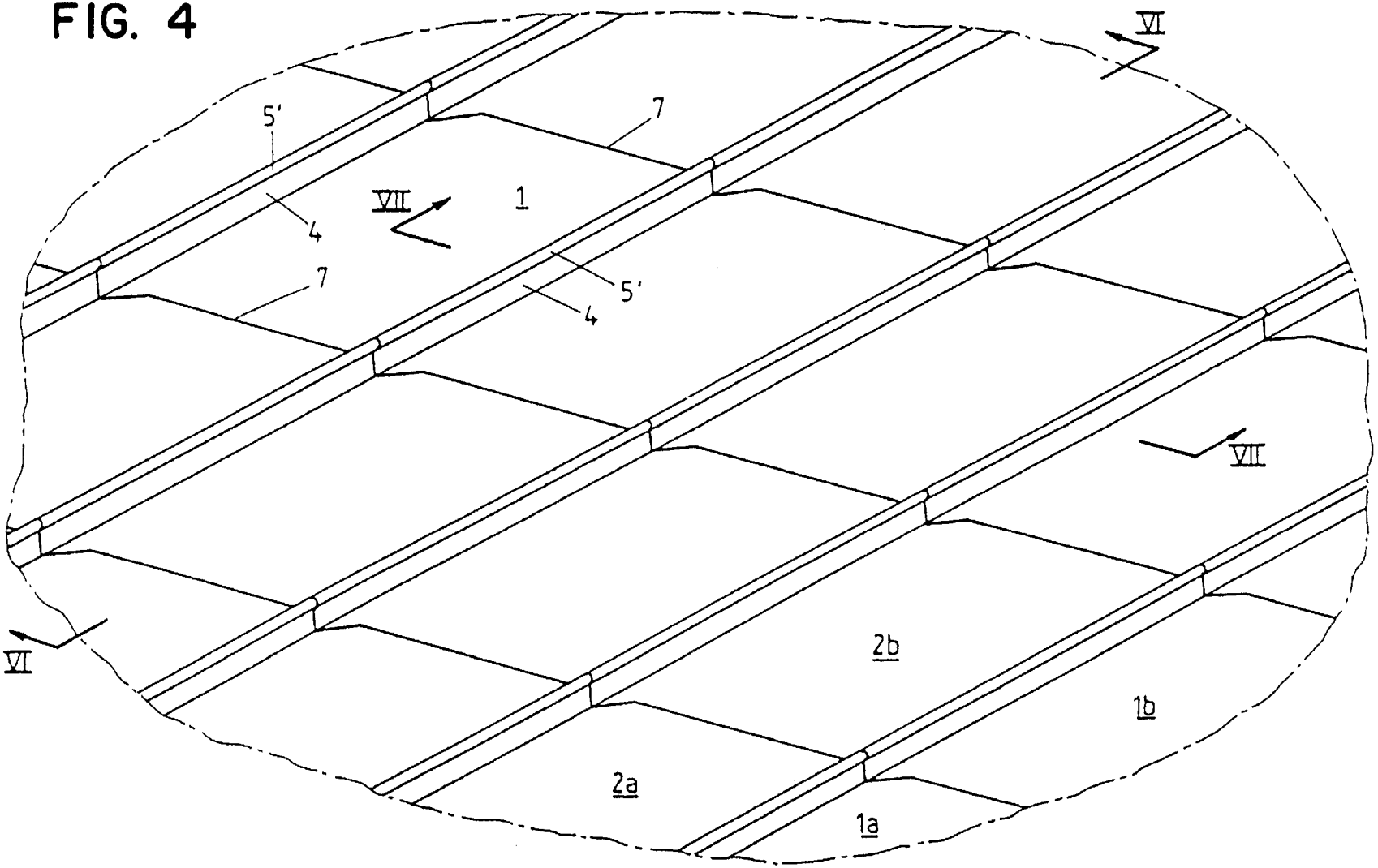
FIG. 4 is a perspective view of a roof part formed by roof cover elements according to this embodiment, with aligned joints.
Figure 5:
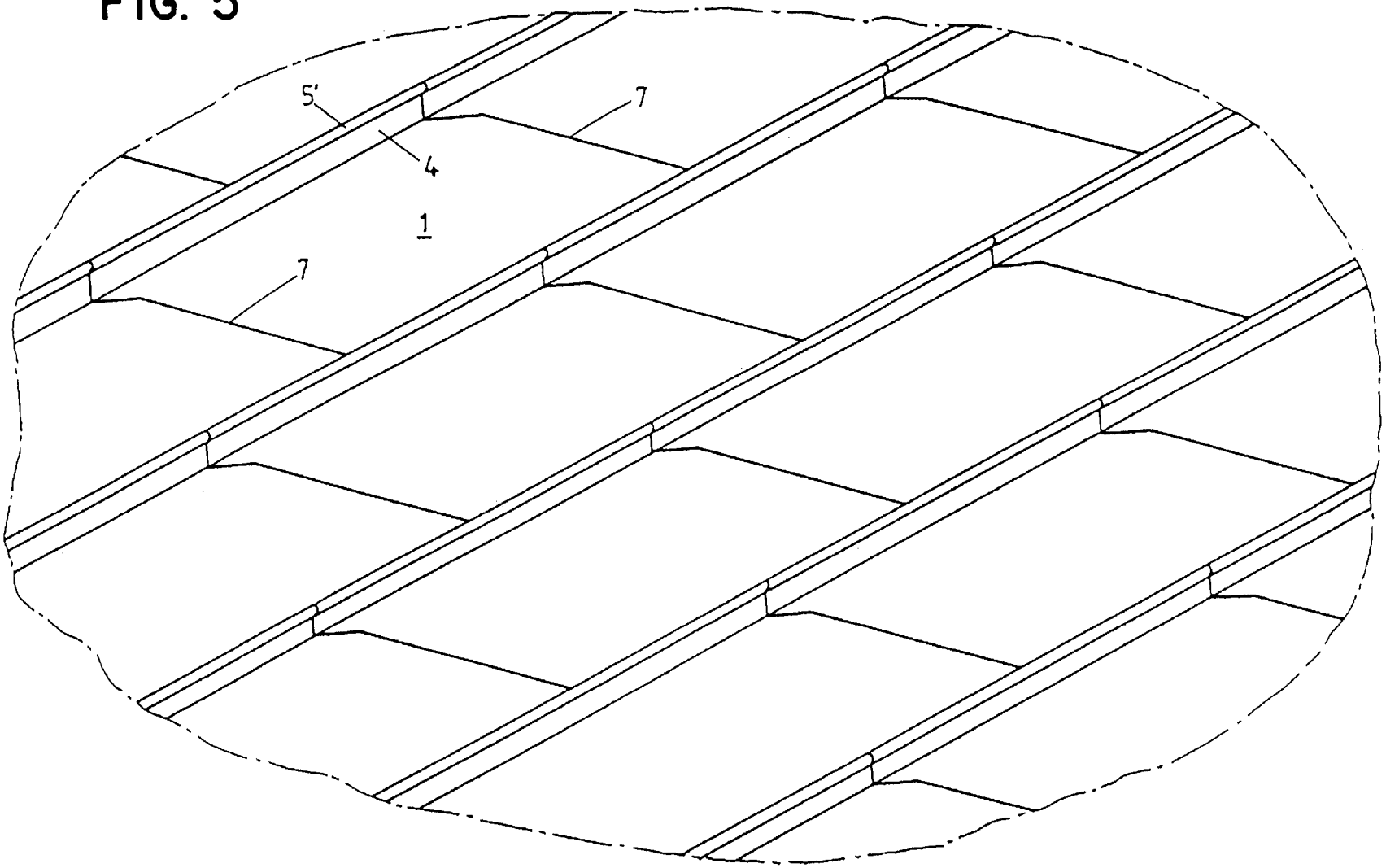
FIG. 5 is a view similar to that of FIG. 4, with offset joints.

The transverse section of the part of the bead 5' close to the large base 6 and that of the bead 5' and of the slit 16 close to the small base 7 are such that in the case of adjacent panels connected end-to-end as in FIGS. 4 and 5, the part of the bead 5' of one panel close to the large base 6 is able to engage in the part of the bead of the other panel close to the small base 7. Thus, the height of the rim 5, close to the shorter base 7, is substantially equal to that of the rim at the location of the retention member 10, minus the height of the said retention member 10. This height corresponds to at least twice the thickness of the panel 1 plus once the thickness of the thin strip forming the retention member 10. In the disclosed embodiment, the decrease in rim height along the panel is at least three times the thickness of the panel, see FIG. 1*a*.

Moreover, the height of the rim 4 close to the shorter base 7 is such that it can engage below the corresponding part of this rim located close to the longer base 6. This operation is facilitated by a bevelling 22 of the edge 4' of the rim 4 close to the longer base 6.

In the embodiment shown in the figures, the part of the bead 5', close to the large base, has a stop in the form of a restriction 17 making it possible to limit the length of engagement of the part of the bead 5', located close to the small base 7 of a second panel, around the part of the bead 5' located close to the large base 6 of a first panel.

Clearance of a few millimeters is preferably provided between two successive roof cover elements 1 in their longitudinal direction so as to make it possible to counteract the effects of thermal expansion of the elements 1 in this direction.

In order to be able to absorb the effects of thermal expansion of the panels in the transverse direction relative to the rims 4 and 5, the latter are somewhat inclined outwards. This creates, between two roof cover elements, a space 20 of a few millimeters. The width of the space 20 varies as a function of the temperature to accommodate thermal expansion.

Moreover, the axis of the cylindrical hollow 15 of the bead 5' extends more or less in the plane of the rim 5 having the said bead 5', this being principally for aesthetic reasons. Also, the dimensions and the form of the rims 4 and 5 varies progressively and continuously between the two bases 6 and 7 of the panel 1. See FIGS. 1, 1*a* and 1*b*.

Although the roof cover element can, in principle, be produced from any weatherproof material suitable for use as roofing, preference is given to a preformed roof cover element consisting of a sheet of zinc, copper, stainless steel or galvanized steel. The particular geometry of the covering element according to the invention greatly facilitates its placing on a roof to be covered. Indeed, it ensures deformation-free engagement of these elements in the longitudinal direction and automatic locking in a perfect position without it being necessary to take any special precaution and without it being necessary to have specific know-how and special equipment.

During the covering of a roof using elements of the type described hereinabove, it is possible to proceed in different ways.

Indeed, fitting may be in the form of aligned joints, as shown in FIG. 4, or of offset joints, as shown in FIG. 5. In the case of fitting with offset joints, use will be made of the roof cover half-elements which allow the offset to be created. The said half-elements have the same geometry as the standard elements, except that their useful length is reduced by half. Placing of the elements, in the case of aligned or offset joints, is achieved from the bottom up, either with staggering by means of oblique progression over the frame, or by means of parallel vertical rows. In the case of placing with offset joints, this will commence with a full-size roof cover element and then continue with a half-element on the side corresponding to the placing direction.

Placing begins after a single marking on the frame to be covered. There is, in fact, little drift to be feared, because the geometry of these elements is sufficiently precise to prevent any play between the elements assembled.

Figure 8:
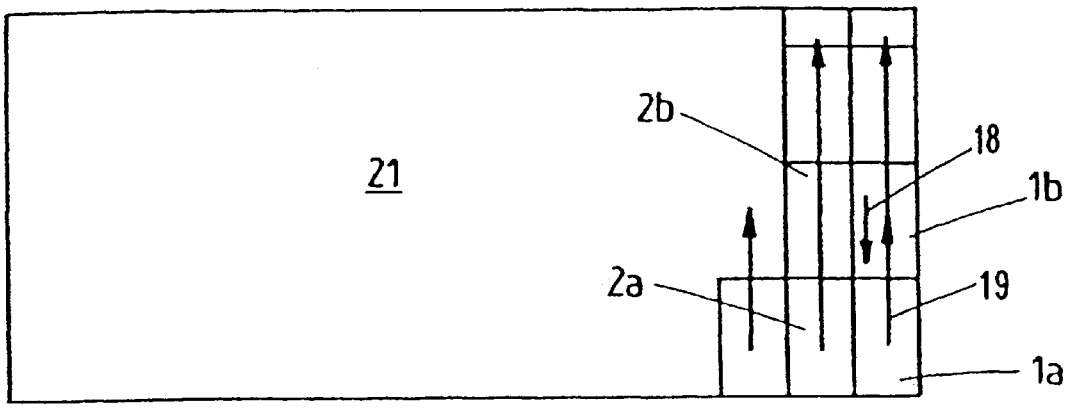
FIGS. 8 and 9 are diagrammatic plan representations of two possible assemblies.
Figure 9:
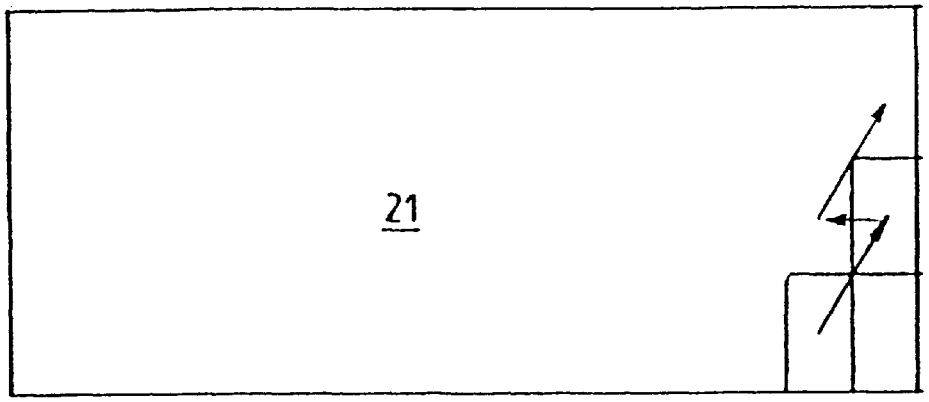

In the case the elements are placed in parallel vertical rows, as shown in FIG. 8, placing is done from right to left where the bead 5' is provided on the straight rim 5 as in the embodiment shown in the figures. Thus, after the placing of the first element 1*a* in the lower right corner on the frame 21, with the large base 6 oriented upwards, a second element 1*b* is placed above the element 1*a*. The second element forms an angle of approximately 45 degrees with the element 1*a* so that their corresponding beads 5' are located in the extension of each other and so that the edge 4 of the second element 1*b* is located above the first element 1*a*.

The second element 1*b* is then displaced downwards, as indicated by the arrow 18, so as to engage its bead 5' along that of the element 1*a* until it abuts on the stop device 17 arranged on the bead of the first element 1*a*. The stop device 17 consists of a restriction in the bead of the element 1*a*. The assembly of the two hems constituting an axis of rotation, it is then possible to pivot the second element 1*b* so as to engage its edge 4' under that of the element 1*a*, through the action of snap-fitting. This operation is facilitated by the bevel cut 22 of the edge 4' of the element 1*a* at its longer base 6. The element 1*b* is then moved upwards according to the arrow 19, which makes it possible to engage its folded edge 13 in the slit 12 of the retention element 10 of the element 1*a*, as shown in greater detail in FIG. 6. The aforesaid engagement is not pushed home, i.e., is made so as to leave a clearance of a few millimeters between the two roof cover elements 1*a* and 1*b* for countering thermal expansion as referred to above.

As in the case of conventional roof cover elements, it is obviously necessary to provide means for fastening the roof cover elements on the support. These fastening means have not been shown in the figures but are in the zone of the panel 1 located close to the large base 6. After the placing of each element, it is necessary to fasten it to the support. In this respect, use may be made of fastening tabs which are traditional in the case of a zinc roof cover, it being possible for them to be attached to the fold 14.

After the placing of the first vertical row of roof cover elements, the next stage in the process is to place elements in the second row, beginning once again towards the bottom. To this end, the bead 5' of the element 2*a* is passed above the edge 41, which is folded as a clip, of the element 1*a*, holding the element 2*a* in an inclined position with respect to the element 1*a*, for example at an angle of 120° with the upper face of the panel 1 of the element 1*a* and making it possible for the folded edge 4' of the rim 4 of the element 2*a* to engage in the cylindrical hollow 15 of the bead 5' of the element 1*a*, passing through the slit 16 of this bead. Once this folded edge 4' has been engaged, the panel 1 of the element 2*a* is brought into the same plane as that of the panel 1 of the element 1*a*, then into its precise position by being slid over the rim 4 of the element 1*a*, i.e. with the corresponding bases 6 and 7 in the extension of each other in the case of placing with aligned joints. In the case of placing with offset joints, the offset between the bases corresponds to a half-length of a standard roof cover element.

For placing the element 2*b*, the procedure is firstly the same as with the element 2*a*, in the manner which has just been described, and then in the same way as with the element 1*b* over the element 1*a* to allow the engagement of the folded edge 13 of the element 2*b* in the slit 12 of the retention member 10 of the element 2*a*.

These operations are repeated thus until the entire roof 21 has been covered by the roof cover elements.

The folded edge 4' in the form of a clip of the rim 4 forms, together with the latter, an angle of less than 90° so as to prevent the penetration of water by capillary effect into the lateral joint between two adjacent rows of roof cover elements. The same applies to the folded edge 14 at the large base 6, which thus prevents the water rising by capillary effect between the superposed parts of two successive elements from being able to pass above the large base 6.

The minimum gradient of these elements is preferably greater than or equal to 15%.

These elements may also be used as cladding panels, i.e. in a substantially vertical position, for example as covering for the facade of a building.

Obviously, it is understood that the invention is not restricted to the specific embodiment described hereinabove and that a number of variants may be envisaged without departing from the scope of the present invention.

Thus, in certain cases, as a function of, for example, the material used to form the roof cover elements, the free edges of the rims 4 and 5 may have other forms.

What is claimed is:

1. A preformed roof cover element comprising a panel of quadrilateral shape having, on each of two non-parallel, opposite sides thereof a rim extending substantially over the whole length of these sides, these two rims being raised on the same face of the panel and comprising means to connect the rim of a first panel to the adjacent rim of an attached second panel oriented in the same direction and located in the same plane as the said first panel, wherein said panel has substantially the shape of an isosceles trapezium having two bases, the length of one of the bases of the trapezium being substantially equal to that of the other base increased by twice the width of a wall of said rims, so as to enable the ends of the rims on the side of the shorter base to engage with the ends of the rims located on the side of the longer base of the panel of another element extending in the direction of the length of said element and said rims; there of wherein the height of said rims, close to the shorter base, is substantially equal to that of said rims at the location of a retention member on said panel, minus at least three times the thickness of the panel;

a free edge of one of said rims is folded towards the other rim and the latter is folded toward the outside of the element, and wherein said rim whose free edge is folded towards the other rim has a transverse section in the form of a clip, said other rim being provided with a bead delimiting a longitudinal cylindrical hollow and forming a slit extending along the outer lateral side of said other rim, the transverse section of the part of said bead close to the longer base and the transverse section of the part of the bead and of the slit close to the shorter base being such that the part of the bead close to the longer base of said element is able to engage in the part of the bead close to the shorter base of said another element while permitting the pivoting of said another element relative to said element about an axis of rotation extending along said engaged beads to permit snap-fitting said rim of said another element in the form of a clip to said rim in the form of a clip of said element.

2. The element according to claim 1, wherein said retention member is provided on said same face of said panel close to said longer base making it possible to immobilize, with respect to each other and in a specific position, said element and said another element in the longitudinal direction of their rims.

3. The element according to claim 2, wherein said retention member has the form of a clip oriented towards the shorter base of said element, said shorter base having an edge which is at least partially folded in the form of a clip towards the face of said panel opposite that on which the retention member is arranged, so as to allow the retention member of said element to interact with the aforesaid folded edge of said another element engaged in the extension of said element in a direction parallel to the longitudinal direction of said rims of said element.

4. The element according to claim 3, wherein said longer base has an edge which is at least partially folded in the opposite direction from the folded edge of said shorter base.

5. The element according to claim 1, wherein the part of the bead close to the longer base has a stop making it possible to limit the length of engagement of the part of the bead located close to the shorter base around the part of the bead located close to the longer base.

6. The element according to claim 1, wherein the part of the free edge of the rim folded towards the other rim located close to the shorter base is such that it is able to engage under the corresponding part of the rim located close to the longer base as a result of said snap-fitting.

7. The element according to claim 1, wherein said rims are inclined outwards.

8. The element according to claim 1, wherein the dimensions and the form of said two rims vary progressively and continuously between the two bases of the panel having the shape of an isosceles trapezium.

9. The element according to claim 1, wherein said panel is a preformed thin metal sheet.

10. The element according to claim 9, wherein said metal sheet is made from zinc, copper, stainless steel or galvanized steel.

* * * * *